US008510911B2

(12) United States Patent
Sawa

(10) Patent No.: US 8,510,911 B2
(45) **Date of Patent: *Aug. 20, 2013**

(54) AUTOMATIC DOOR CLOSING HINGE AND DOUBLE SWING DOOR STRUCTURE

(75) Inventor: Takashi Sawa, Yamanashi (JP)

(73) Assignee: Sawa Corporation, Kitatsuru-gun (JP)

( * ) Notice: Subject to any disclaimer, the term of this patent is extended or adjusted under 35 U.S.C. 154(b) by 378 days.

This patent is subject to a terminal disclaimer.

(21) Appl. No.: 12/735,465

(22) PCT Filed: Jan. 28, 2009

(86) PCT No.: PCT/JP2009/051820

§ 371 (c)(1),
(2), (4) Date: Jul. 19, 2010

(87) PCT Pub. No.: WO2009/099078

PCT Pub. Date: Aug. 13, 2009

(65) Prior Publication Data

US 2010/0319260 A1 Dec. 23, 2010

(30) Foreign Application Priority Data

Feb. 5, 2008 (JP) ..... 2008-024822

(51) Int. Cl.
*E05F 3/20* (2006.01)

(52) U.S. Cl.
USPC ..... 16/50; 16/54; 16/310; 16/313

(58) Field of Classification Search
USPC ..... 49/381, 384, 386, 397, 236, 237, 49/238; 16/54, 50, 313–314, 352, 318, 330, 16/303, 310
See application file for complete search history.

(56) References Cited

U.S. PATENT DOCUMENTS 1,200,538 A * 10/1916 Smith et al. ..... 16/303
2,118,950 A * 5/1938 Stannard ..... 16/54
2,127,327 A * 8/1938 De Millar ..... 16/54
2,164,358 A * 7/1939 Stannard ..... 16/54

(Continued)

FOREIGN PATENT DOCUMENTS

JP 09184354 A * 7/1997
JP 2000-120319 A 4/2000

(Continued)

OTHER PUBLICATIONS

International Search Report dated Mar. 24, 2009, issued on PCT/JP2009/051820.

*Primary Examiner* — Chuck Y. Mah
(74) *Attorney, Agent, or Firm* — Edwards Wildman Palmer LLP

(57) ABSTRACT

A hinge, for automatically-closing a door which opens in both directions, includes a cylinder (2); an operating rod (3) to be rotatable and restricted from moving in the longitudinal direction; two substantially V-shaped grooves (33) provided on an outer periphery of the operating rod (3) in the cylinder (2) to oppose to each other; two spheres (55) provided engage the substantially V-shaped grooves (33); an upper piston (5) engaged with the spheres (55); a compression coil spring (4) disposed between the upper piston (5) and an upper end portion of the cylinder (2) and configured to urge the upper piston (5) to the other end side of the cylinder (2), and a fluid pressure shock absorbing mechanism configured to absorb a shock caused by the movement of the upper piston 5 to the other end side with a liquid pressure.

20 Claims, 3 Drawing Sheets

(56) References Cited

U.S. PATENT DOCUMENTS

| | | | | | |
|---|---|---|---|---|---|
| 2,456,537 | A | * | 12/1948 | Seaman et al. | 16/54 |
| 4,100,646 | A | * | 7/1978 | Schubeis | 16/54 |
| 4,391,020 | A | * | 7/1983 | Hsu | 16/314 |
| 4,485,522 | A | * | 12/1984 | Chen | 16/54 |
| 4,788,746 | A | * | 12/1988 | Idler | 16/297 |
| 4,829,628 | A | * | 5/1989 | Vuksic | 16/54 |
| 6,205,619 | B1 | * | 3/2001 | Jang | 16/352 |
| 6,658,694 | B2 | * | 12/2003 | Wang | 16/50 |
| 2003/0229965 | A1 | * | 12/2003 | Wang | 16/54 |
| 2004/0068833 | A1 | | 4/2004 | Sawa | |
| 2004/0250377 | A1 | * | 12/2004 | Park | 16/50 |

FOREIGN PATENT DOCUMENTS

| | | | | |
|---|---|---|---|---|
| JP | 3984380 | A | | 5/2000 |
| JP | 3638526 | | | 7/2002 |
| JP | 2002-303072 | A | | 10/2002 |
| JP | 3713448 | | | 10/2002 |
| JP | 2005-113682 | A | | 4/2005 |
| JP | 2006214190 | A | * | 8/2006 |
| JP | 4045294 | | | 2/2008 |
| WO | WO 9954583 | A2 | * | 10/1999 |
| WO | WO-2009/069237 | A1 | | 6/2009 |

* cited by examiner

AUTOMATIC DOOR CLOSING HINGE AND DOUBLE SWING DOOR STRUCTURE

TECHNICAL FIELD

The present invention relates to a hinge for automatically-closing a door which opens in both directions, having a buffering function, and structure for a door which opens in both directions having the hinge for automatically-closing a door which opens in both directions.

BACKGROUND ART

In the related art, an automatically-closing door hinge configured to rotate an opened door in a closing direction automatically using a restoring force of a coil spring and provided with a shock absorbing function for absorbing a shock applied when the door is closed using a hydraulic cylinder is known and, in recent years, an automatically-closing door hinge configured to absorb a shock with an air damper instead of the hydraulic cylinder is proposed. For example, disclosed in Patent Document 1 (JP-A-2002-303072) and Patent Document 2 (JP-A-2005-113682) are an automatically-closing door hinge on the basis of an air damper including a piston stored and arranged in a cylinder provided on one of a pair of vanes, and an operating rod fixed to an upper portion of the other vane and arranged within the cylinder, wherein spheres disposed at a predetermined position of the piston so as to roll over and projecting from an inner periphery thereof are engaged with a cam groove being formed on an outer periphery of a lower portion of the operating rod and having an inclined portion, the piston is moved forward and backward corresponding to the movement of the spheres with respect to the inclined portion of the cam groove, and a shock is absorbed by an air cushioning in the cylinder on the basis of a returning action of the piston when the door is closed.

DISCLOSURE OF INVENTION

Incidentally, the above-described automatically-closing door hinge configured to use hydraulic pressure or pneumatics to absorb a shock applied when closing the door is designed for one-side opening doors, which is opened outward or inward, and hence cannot be installed on a door which opens in both directions, that is opened both inward and outward. Therefore, the automatically-closing door hinge with a shock absorbing function, which can be installed on the doors which opens in both directions, that is opened both inward and outward, is being called for.

In view of such problem as described above, it is an object of the present invention to provide a hinge for automatically-closing a door which opens in both directions with a shock absorbing function, which allows installation on door which is opened both inward and outward, and structure for a door which opens in both directions provided with the automatically-closing door hinge.

A hinge adapted for automatically-closing a door which opens in both directions in the present invention includes:

a cylinder; an operating rod attached to one end of the cylinder so as to be rotatable and restricted from moving in the longitudinal direction; two substantially V-shaped grooves provided on an outer periphery of the operating rod in the cylinder so as to oppose to each other; two spheres provided so as to engage the substantially V-shaped grooves and disposed so as to oppose to each other; a piston engaged with the spheres and moved in the cylinder in the longitudinal direction in conjunction with the movement of the spheres with respect to the substantially V-shaped groove; a compression coil spring disposed between the piston and an upper end portion of the cylinder and configured to urge the piston to the other end side of the cylinder; and a fluid pressure shock absorbing mechanism configured to absorb a shock caused by the movement of the piston to the other end side with a liquid pressure.

The hinge for automatically-closing a door which opens in both directions according to the present invention is characterized in that the substantially V-shaped grooves are formed so as to continue circumferentially.

The hinge for automatically-closing a door which opens in both directions according to the present invention is also characterized in that the fluid pressure shock absorbing mechanism is configured in such a manner that another piston including a bottom plate and a shaft portion is provided on a lower side of the piston with the shaft portion fixed to a bottom portion of the piston, a diaphragm having a flow channel is provided between the bottom portion of the piston and the bottom portion of the another piston, a bottleneck of the flow channel of the diaphragm in a case where a fluid flows from a first fluid chamber to a second fluid chamber is set to be smaller than a bottleneck of the flow channel of the diaphragm in the case where the fluid flows from the second flow chamber to the first flow chamber, where the first fluid chamber is a portion between the bottom portion of the piston and the diaphragm and the second fluid chamber is a portion between the diaphragm and the bottom portion of the another piston.

The hinge for automatically-closing a door which opens in both directions according to the present invention is characterized in that a bottom portion of the cylinder is formed with an air vent hole, an air trap is formed between the bottom portion of the another piston and the bottom portion of the cylinder according to the upward movement of the another piston, and the air trap is released according to the downward movement of the another piston.

The hinge for automatically-closing a door which opens in both directions according to the present invention is characterized in that the fluid pressure shock absorbing mechanism is a hydraulic shock absorbing mechanism configured to use a hydraulic pressure to absorb a shock caused by the movement of the piston to the other end side. With the provision of the hydraulic shock absorbing mechanism, a smoother shock absorbing action is enabled. Instead of the oil, other viscous liquids may be used.

The hinge for automatically-closing a door which opens in both directions according to the present invention is characterized in that the fluid pressure shock absorbing mechanism is a pneumatic shock absorbing mechanism configured to use pneumatics to absorb a shock caused by the movement of the piston to the other end side. With the pneumatic shock absorbing mechanism, oil leakage or the like which may occur when using oil is prevented.

The hinge for automatically-closing a door which opens in both directions according to the present invention has structure for a door which opens in both directions, that is structure which allows opening and closing both inward and outward, wherein the hinge for automatically-closing a door which opens in both directions according to the present invention is installed on a door supporting portion or a door, and a receiving hinge to be attached to the hinge for automatically-closing a door which opens in both directions is installed on the door or the door supporting portion. The door supporting portion is, for example, a column or door frame as appropriate.

In addition to the configurations in the respective inventions or the respective embodiments, the invention disclosed in this specification includes those specified by modifying partial configurations as described above into other configurations disclosed in this specifications, or those specified by adding other configurations disclosed in this specification to these configurations, or superordinate concept specified by eliminating partial configurations therefrom to an extent which still provides partial advantages thereof.

According to the present invention, when the door is opened inward, the each sphere moves relatively with respect to one of the inclined portions of the substantially V-shaped groove. When the door is opened outward, the each sphere moves relatively with respect to the other inclined portion of the substantially V-shaped groove. Therefore, the door which opens in both directions and which can be opened and closed both inward and outward can be automatically closed with the compression coil spring, and the shock of a door closing action of the door which opens in both directions can be absorbed by the hydraulic pressure or the pneumatics. Since the structure is simple, it can be manufactured easily at a low cost, and downsizing and hence saving of the installation space can also be achieved. Also, with the configuration in which the spheres are engaged with the substantially V-shaped grooves, the inclination or the pitch of the substantially V-shaped grooves can be set freely and adapted freely to the opening and closing states of the door which opens in both directions such as the degree of opening of the door which opens in both directions. With the configuration in which the spheres move along the substantially V-shaped grooves, the spheres move smoothly with a low frictional resistance, and the piston is smoothly traveled, so that the smoothening of the opening and closing actions of the door which opens in both directions is achieved.

Also, by forming the substantially V-shaped grooves so as to continue circumferentially, the manufacturing process is simplified.

Also, the shock absorbing mechanism operated in conjunction with the forward and backward movement of the piston is obtained easily at a low cost by fixing the another piston to the piston, forming the first and second fluid chambers by the piston, the another piston and the diaphragm, and configuring the fluid pressure shock absorbing mechanism by allowing the fluid to circulate between the first and second fluid chambers. With the configuration as described above, the shock absorbance superior in stability is also achieved.

Furthermore, with the configuration in which the air trap is formed between the bottom portion of the another piston and the bottom portion of the cylinder according to the upward movement of the another piston, and the air trap is released according to the downward movement of the another piston, the shock absorbance of the door closing action on the basis of the air cushioning is achieved in addition to the shock absorbance on the basis of the fluid pressure.

BEST MODES FOR CARRYING OUT THE INVENTION

Figure 1:
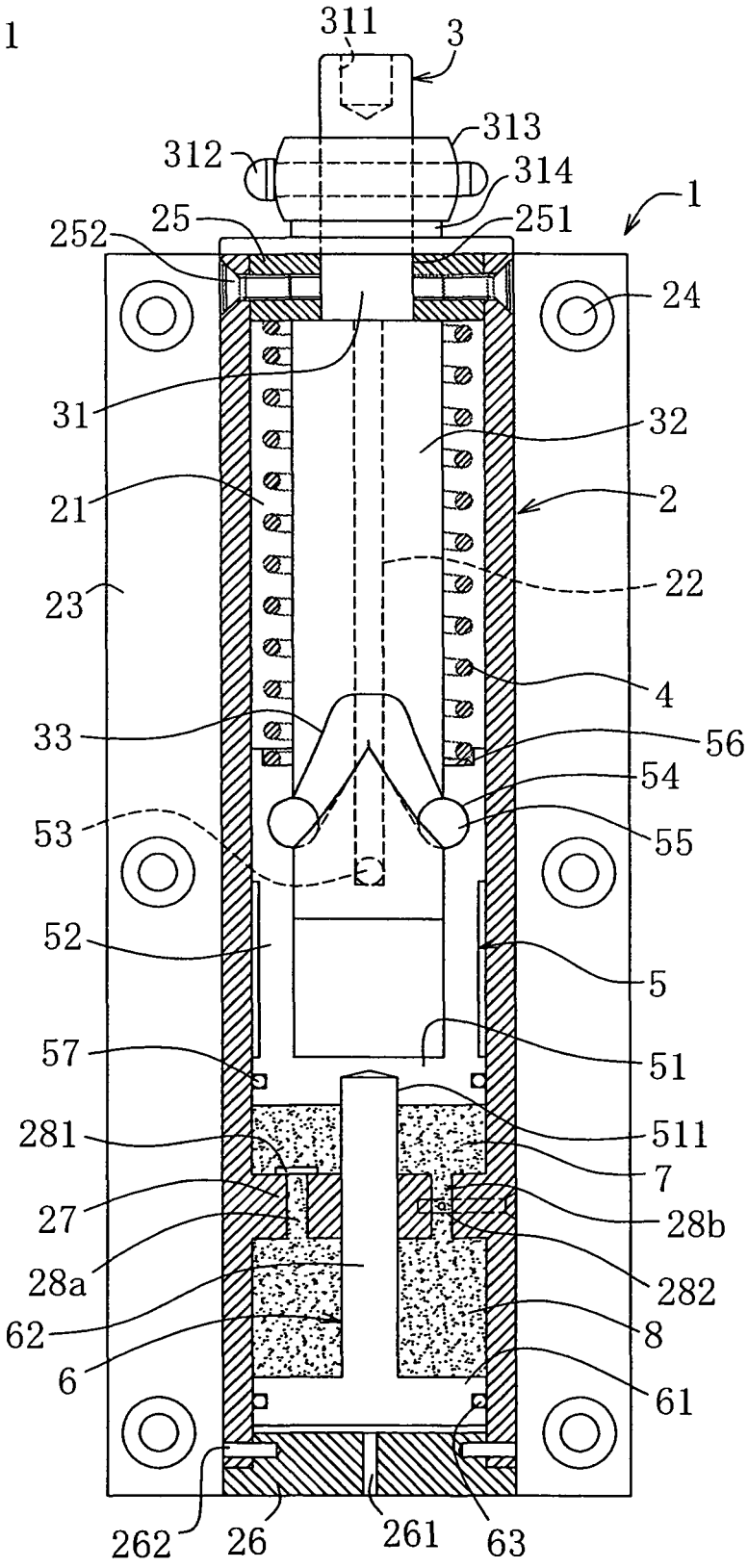
FIG. 1 is an explanatory drawing, partly in vertical cross section, of a hinge for automatically-closing a door which opens in both directions according to an embodiment of the present invention showing a state corresponding to a door-closed state.

Referring now to the drawings, embodiments of the invention will be described.

Figure 2:
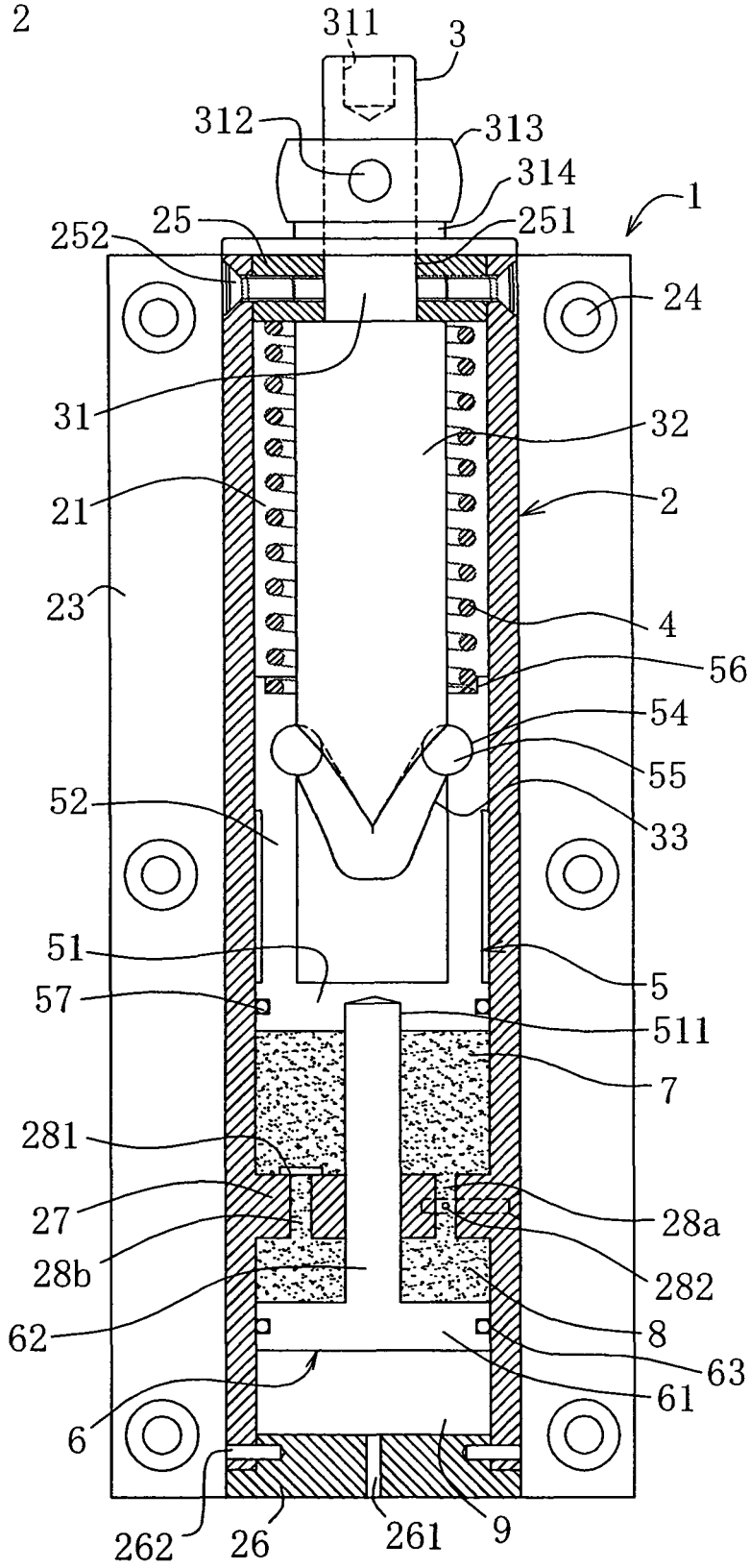
FIG. 2 is an explanatory drawing, partly in vertical cross section, of the hinge for automatically-closing a door which opens in both directions shown in FIG. 1 showing a state corresponding to a door-opened state.

A hinge for automatically-closing a door which opens in both directions 1 according to this embodiment includes a cylinder 2, an operating rod 3 rotatably attached to the cylinder 2 so as to project partly outward from an upper end side of the cylinder 2, a compression coil spring 4 mounted in the cylinder 2 and arranged on an outer periphery of the operating rod 3, an upper piston 5 mounted in the cylinder 2 and arranged on the outer periphery of the operating rod 3, and a lower piston 6 mounted in the cylinder 2 and attached to a lower side of the upper piston 5 as shown in FIG. 1 and FIG. 2.

The cylinder 2 has a hollow portion 21 of a substantially cylindrical shape, and is formed with depressed grooves 22 at front and rear positions of an inner surface thereof respectively so as to extend in the vertical direction. A rectangular mounting panel 23 is integrally formed on a back surface side of the cylinder 2 so as to project sideward to the left and right, so that the cylinder 2 can be attached to a column, a door frame and the like by inserting flat countersunk head screws or the like through mounting holes 24 of the mounting panel 23. An upper cap 25 is attached to an upper end of the cylinder 2 by being fixed with flat countersunk head screws 252, and the upper cap 25 is formed with an inserting hole 251 for allowing insertion of the operating rod 3 at the center thereof. Also, a lower cap 26 is fixedly attached to a lower end of the cylinder 2 with mounting pins 262, and the lower cap 26 is formed with an air vent hole 261 at the center thereof.

The operating rod 3 includes a small diameter portion 31 provided at a substantially upper portion, and a large diameter portion 32. Amounting hole 311 of a hexagonal shape in plan view is formed on an upper end of the small diameter portion 31. A projecting portion 313 is provided at a substantially center of the small diameter portion 31 with a mounting pin 312 penetrated therethrough in the lateral direction, and a loose ring 314 which absorbs a shock is provided on an outer periphery of the small diameter portion 31 so as to be capable of turning freely under the projecting portion 313. The small diameter portion 31 is inserted into the inserting hole 251 of the upper cap 25 fixed to an upper end of the hollow portion 21, and the loose ring 314 to be pressed from above by the projecting portion 313 is in abutment with an upper surface of the upper cap 25. In this state, an upper end surface of the large diameter portion 32 is arranged in the vicinity of a lower surface of the upper cap 25, and the loose ring 314 and the upper end surface of the large diameter portion 32 are caught by the upper and lower surfaces of the upper cap 25, so that the vertical movement of the operating rod 3 is restricted.

Formed on an outer peripheral surface of a substantially lower portion of the large diameter portion 32 are two substantially V-shaped cam grooves 33 provided at opposed positions so as to continue circumferentially. The substantially V-shaped cam grooves 33 each have an upper end at a center front position and is formed from the center front position obliquely downward toward the left and right respectively along the outer peripheral surface, and have lower ends at side center positions shifted from the front center position by 90° leftward and rightward, respectively, in a state corresponding to the door-closed state shown in FIG. 1. Then, the cam groove 33 is formed along the outer peripheral surface from the side center positions of the lower ends to a back center position obliquely upward, and has an upper end at the back center position, whereby the upper ends and the lower ends of the cam grooves 33 are formed at the corresponding positions. In other words, the cam grooves 33 are formed into an inverted V-shape in front view and back view and into a V-shape in side views in a state corresponding to door-closed state, and vice versa in the state corresponding to the door-opened state.

The upper piston 5 has a substantially bottomed cylindrical shape having a bottom plate 51 and a peripheral wall 52. The bottom plate 51 is formed with a mounting hole 511 at the center of a lower surface thereof for fixing a shaft portion 62 of the lower piston 6, described later, so as not to penetrate therethrough. The mounting hole 511 is formed with, for example, a female thread, so that a male thread formed on the shaft portion 62 is screwed therein for fixation. The bottom plate 51 is formed with an oil seal 57, which is a seal member, on the peripheral surface thereof continuously in the circumferential direction, whereby oil is prevented from flowing out to an upper side of the oil seal 57. The peripheral wall 52 is provided with pins 53 projecting outward at respective center positions of the front and back in FIG. 1 and FIG. 2, and the pins 53 engage the depressed grooves 22 on the inner surface of the cylinder 2. By the pins 53 moving upward and downward while engaging the depressed grooves 22, the upper piston 5 is capable of moving upward and downward without rotating.

In addition, on an inner peripheral surface of the peripheral wall 52, spherical depressed portions 54 in a substantially semispherical shape are formed at the left and right side center positions in FIG. 1 respectively, and two spheres 55 are disposed in engagement with the spherical depressed portions 54 and the cam grooves 33 on the operating rod 3 respectively so as to be capable of rolling. The spheres 55 are constantly positioned at the left and right side center positions in FIG. 1 by the engagement with the unrotatable upper piston 5 even when the operating rod 3 is rotated. Then, when the operating rod 3 is rotated from the state shown in FIG. 1 to the state shown in FIG. 2 by an external force, the spheres 55 roll along the inclination of the cam grooves 33, and are moved from the lower ends to the upper ends with respect to the cam grooves 33, so that the upper piston 5 is moved upward. Also, a butted position between the inner peripheral surface and the upper end surface of the upper piston 5 of the peripheral wall 52 is cut out into an L-shape circumferentially to form a depressed portion 56 at a lower level than the upper end surface.

The compression coil spring 4 is provided around the outer periphery of the large diameter portion 32 of the operating rod 3, and the lower end thereof is placed on a lower surface of the depressed portion 56 of the upper piston 5, while the upper end thereof is in abutment with the lower surface of the upper cap 25. When the upper piston 5 is moved upward with the rotation of the operating rod 3 by the external force described above, the compression coil spring 4 is compressed by the upward movement of the depressed portion 56. In contrast, when the external force is removed, the upper piston 5, whose depressed portion 56 is urged downward by the compression coil spring 4 being restored and expanded, is moved downward, and the spheres 55 are moved from the upper ends to the lower ends of the cam grooves 33 with respect to the substantially V-shaped cam grooves 33, so that the operating rod 3 is rotated from the state shown in FIG. 2 to the state shown in FIG. 1.

The lower piston 6 has a substantially push-pin shape having a bottom plate 61 and the shaft portion 62 formed so as to project upward from the center of the bottom plate 61. The bottom plate 61 is formed with an oil seal 63, which is a seal member, on the outer peripheral surface thereof continuously in the circumferential direction, whereby oil is prevented from flowing out to a lower side of the oil seal 63. The distal end of the shaft portion 62 is inserted and secured in the mounting hole 511 of the upper piston 5, and the securement described above is achieved by screwing between the shaft portion 62 and the mounting hole 511 or the like. An air trap 9 is formed between a lower surface of the bottom plate 61 of the lower piston 6 and the lower cap 26 by intaking air from the air vent hole 261 of the lower cap 26 when the lower piston 6 is moved upward.

A diaphragm 27 is provided between the bottom plate 51 of the upper piston 5 and the bottom plate 61 of the lower piston 6. A first fluid chamber 7 is formed between the bottom plate 51 of the upper piston 5 and the diaphragm 27. A second fluid chamber 8 is formed between the diaphragm 27 and the bottom plate 61 of the lower piston 6. The first fluid chamber 7 and the second fluid chamber 8 are filled with oil, respectively. The diaphragm 27 is formed with a flow channel 28*a* in which a seat valve 281 is provided and a flow channel 28*b* in which a flow channel adjusting pin 282 is provided. The seat valve 281 is partly secured to an upper surface of the diaphragm 27 at a position in the vicinity of the periphery of the flow channel 28*a*, and is configured in such a manner that a portion of the seat valve 281, which is not secured, is lifted to allow oil to flow in for the flow of the oil from the second fluid chamber 8 to the first fluid chamber 7, and closes an upper opening of the flow channel 28*a* to block the oil from flowing in for the flow of the oil from the first fluid chamber 7 to the second fluid chamber 8. The flow channel adjusting pin 282 is provided by being inserted at aright angle with respect to the longitudinal direction of the flow channel 28*b* so as to close the flow channel 28*b*, and is formed with a through hole at a position corresponding to the flow channel 28*b*. Therefore, the amount of oil flowing through the flow channel 28*b* can be adjusted by adjusting the direction of penetration of the through hole within the range from the direction along the flow channel 28*b* to the direction at a right angle with respect to the flow channel 28*b*.

Figure 3:
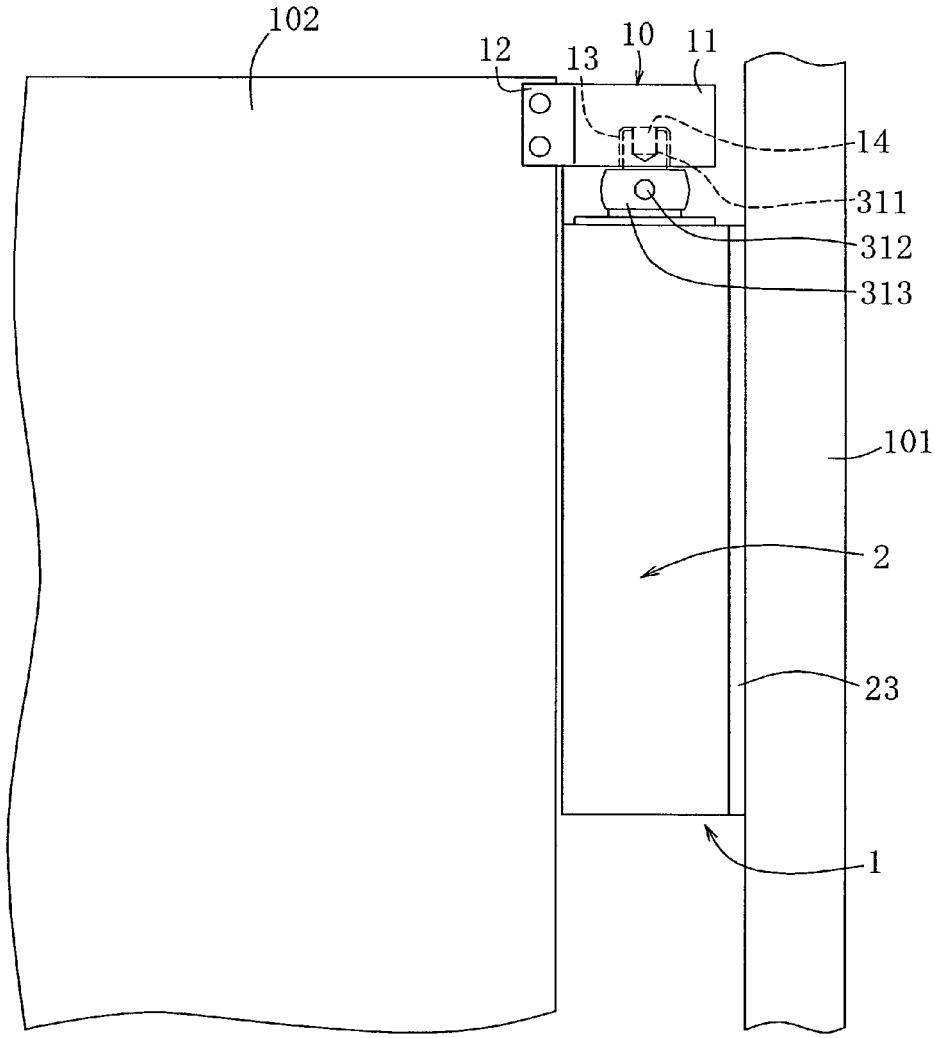
FIG. 3 is a partial front view showing structure for a door which opens in both directions provided with the hinge for automatically-closing a door which opens in both directions shown in FIG. 1.

As shown in FIG. 3 for example, the hinge for automatically-closing a door which opens in both directions 1 is attached to a column 101 by placing the mounting panel 23 of the cylinder 2 along a side surface of the column 101 and inserting the flat countersunk head screws or the like through the mounting holes 24. Also, a receiving hinge 10 is attached to a right upper corner of a door 102 by fixing a vane 12 and the door 102 with flat countersunk head screws inserted therethrough, for example. A projection 14 being hexagonal in plan view is formed on an upper end of a mounting hole 13 formed on a lower surface of a base member 11 of the receiving hinge 10 so as to project downward therefrom, and the receiving hinge 10 is fixedly attached to the operating rod 3 by inserting an upper end of the operating rod 3 into the mounting hole 12 and fitting the projection 14 to the mounting hole 311 formed at the upper end of the operating rod 3. In the same manner, on a right lower corner of the door 102 and a portion of the column 101 corresponding thereto, the receiving hinge 10 and the hinge for automatically-closing a door which opens in both directions 1, or a normal hinge for the door which opens in both directions and is opened inward and outward can be provided. In the latter case, a vacant hinge having no shock absorbing function or door-closing function can be used.

In the door-closed state in FIG. 3, the hinge for automatically-closing a door which opens in both directions 1 assumes the state shown in FIG. 1. Then, when the door 102 is opened, the operating rod 3 rotates, and the spheres 55 roll to move from the lower ends to the substantially upper ends of the substantially V-shaped cam grooves 33, then the upper piston 5 is moved upward to compress the compression coil spring 4 and simultaneously, the lower piston 6 is moved upward according to the upward movement of the upper piston 5, so that the door-open state shown in FIG. 2 is assumed. As regards the upward movement of the pistons 5, 6, the capacity of the first fluid chamber 7 is expanded and the interior of the first fluid chamber 7 is decompressed as the upper piston 5 moves upward, while the capacity of the second fluid chamber 8 is reduced and the interior of the second fluid chamber 8 is compressed as the lower piston 6 moves upward, whereby the oil in the second fluid chamber 8 flows into the first fluid chamber 7 via the flow channels 28*a*, 28*b*. In the inflow as described above, the oil flows inward while lifting the seat valve 281 upward in the flow channel 28*a* having the seat valve 281 therein, and the oil flows in through a gap slightly opened by the flow channel adjusting pin 282 in the flow channel 28*b* having the flow channel adjusting pin 282. With the upward movement of the lower piston 6, air flows into the interior of the cylinder 2 from the air vent hole 261, and the air trap 9 is formed between a bottom portion of the lower piston 6 and the lower cap 26.

When a user releases his or her hand from the door 102 and hence the external force is removed, the compression coil spring 4 is restored and expanded, and the upper piston 5 is moved downward, whereby the spheres 55 roll to move from the substantially upper ends to the lower ends of the substantially V-shaped cam grooves 33, and the operating rod 3 rotates, so that the state is translated from the door-opened state in FIG. 2 to the door-closed state in FIG. 1. In the door closing action described above, the lower piston 6 is also moved downward as the upper piston 5 moves downward, the capacity of the first fluid chamber 7 is reduced and the interior of the first fluid chamber 7 is compressed as the upper piston 5 moves downward, while the capacity of the second fluid chamber 8 is expanded and the interior of the second fluid chamber 8 is decompressed as the lower piston 6 moves downward, whereby the oil in the first fluid chamber 7 flows into the second fluid chamber 8 via the flow channel 28*a*. In the inflow as described above, since the flow channel 28*a* having the seat valve 281 is closed by the seat valve 281 being pressed against the diaphragm 27 around the flow channel 28*a*, the oil flows in through the gap slightly opened by the flow channel adjusting pin 282 in the flow channel 28*b* having the flow channel adjusting pin 282.

In other words, a bottleneck of a flow channel of the diaphragm 27 when the oil flows from the second fluid chamber 8 to the first fluid chamber 7 corresponds to the amount of opening of the flow channel 28*a* determined by the seat valve 281 and the amount of opening of the flow channel 28*b* determined by the flow channel adjusting pin 282, and the bottleneck of the flow channel of the diaphragm 27 when the oil flows from the first fluid chamber 7 to the second fluid chamber 8 corresponds to the amount of opening of the flow channel 28*b* determined by the flow channel adjusting pin 282. The bottleneck of the flow channel 28*b* of the diaphragm 27 when the oil flows from the first fluid chamber 7 to the second fluid chamber 8 is smaller than the bottlenecks of the flow channels 28*a*, 28*b* of the diaphragm 27 when the fluid flows from the second fluid chamber 8 to the first fluid chamber 7. Therefore, the flow of the oil slows down, and the shock of the door closing returning action is absorbed. In addition, the air in the interior of the cylinder 2 flows out from the air vent hole 261 as the lower piston 6 moves downward, and the air trap 9 is released. Even with the outflow of the air from the small air vent hole 261, the air cushioning is effected and the air cushioning contributes to the shock absorbance of the door closing returning action.

The present invention is not limited to the embodiment described above, and various modifications are possible. For example, the two substantially V-shaped cam grooves 33 provided on the outer periphery of the operating rod 3 so as to oppose to each other in the embodiment described above are formed so as to continue circumferentially. However, the substantially V-shaped cam grooves 36 may be provided separately at two positions opposing to each other. Alternatively, the fluid to be filled in the fluid chambers 7, 8 is not limited to the oil, and may be other viscous liquids or even air. When the air is used as the fluid pressure shock absorbing mechanism, the existing air damper unit as described in Patent Documents 1 or 2 may be employed under the piston.

INDUSTRIAL APPLICABILITY

The present invention can be used as a hinge for a door which opens in both directions and which is opened inward and outward.

The invention claimed is:

1. A hinge for automatically-closing a door which opens in both directions comprising:

a cylinder;

an operating rod attached to one end of the cylinder so as to be rotatable and restricted from moving in the longitudinal direction;

two substantially V-shaped grooves provided on an outer periphery of the operating rod in the cylinder so as to oppose to each other;

two spheres provided so as to engage the substantially V-shaped grooves and disposed so as to oppose to each other;

a piston engaged with the spheres and moved in the cylinder in the longitudinal direction in conjunction with the movement of the spheres with respect to the substantially V-shaped groove;

a compression coil spring disposed between the piston and an upper end portion of the cylinder and configured to urge the piston to the other end side of the cylinder; and a fluid pressure shock absorbing mechanism configured to absorb a shock caused by the movement of the piston to the other end side with a liquid pressure.

2. The hinge for automatically-closing a door which opens in both directions according to claim 1, wherein the substantially V-shaped grooves are formed so as to continue circumferentially.

3. The hinge for automatically-closing a door which opens in both directions according to claim 2, wherein the fluid pressure shock absorbing mechanism is configured in such a manner that another piston including a bottom plate and a shaft portion is provided on a lower side of the piston with the shaft portion fixed to a bottom portion of the piston, a diaphragm having a flow channel is provided between the bottom portion of the piston and the bottom portion of the another piston, a bottleneck of the flow channel of the diaphragm in a case where a fluid flows from a first fluid chamber to a second fluid chamber is set to be smaller than a bottleneck of the flow channel of the diaphragm in the case where the fluid flows from the second flow chamber to the first flow chamber, where the first fluid chamber is a portion between the bottom portion of the piston and the diaphragm and the second fluid chamber is a portion between the diaphragm and the bottom portion of the another piston.

4. The hinge for automatically-closing a door which opens in both directions according to claim 3, wherein a bottom portion of the cylinder is formed with an air vent hole, an air trap is formed between the bottom portion of the another piston and the bottom portion of the cylinder according to the upward movement of the another piston, and the air trap is released according to the downward movement of the another piston.

5. The hinge for automatically-closing a door which opens in both directions according to claim 3, wherein the fluid pressure shock absorbing mechanism is a hydraulic shock absorbing mechanism configured to use a hydraulic pressure to absorb a shock caused by the movement of the piston to the other end side.

6. The hinge for automatically-closing a door which opens in both directions according to claim 3, wherein the fluid pressure shock absorbing mechanism is a pneumatic shock absorbing mechanism configured to use pneumatics to absorb a shock caused by the movement of the piston to the other end side.

7. The hinge for automatically-closing a door which opens in both directions according to claim 2, wherein the fluid pressure shock absorbing mechanism is a hydraulic shock absorbing mechanism configured to use a hydraulic pressure to absorb a shock caused by the movement of the piston to the other end side.

8. The hinge for automatically-closing a door which opens in both directions according to claim 2, wherein the fluid pressure shock absorbing mechanism is a pneumatic shock absorbing mechanism configured to use pneumatics to absorb a shock caused by the movement of the piston to the other end side.

9. A structure for a door which opens in both directions which allows opening and closing inward and outward, wherein the hinge for automatically-closing a door which opens in both directions according to claim 2 is installed on a door supporting portion or a door, and a receiving hinge to be attached to the hinge for automatically-closing a door which opens in both directions is installed on the door or the door supporting portion.

10. The hinge for automatically-closing a door which opens in both directions according to claim 1, wherein the fluid pressure shock absorbing mechanism is configured in such a manner that another piston including a bottom plate and a shaft portion is provided on a lower side of the piston with the shaft portion fixed to a bottom portion of the piston, a diaphragm having a flow channel is provided between the bottom portion of the piston and the bottom portion of the another piston, a bottleneck of the flow channel of the diaphragm in a case where a fluid flows from a first fluid chamber to a second fluid chamber is set to be smaller than a bottleneck of the flow channel of the diaphragm in the case where the fluid flows from the second flow chamber to the first flow chamber, where the first fluid chamber is a portion between the bottom portion of the piston and the diaphragm and the second fluid chamber is a portion between the diaphragm and the bottom portion of the another piston.

11. The hinge for automatically-closing a door which opens in both directions according to claim 10, wherein a bottom portion of the cylinder is formed with an air vent hole, an air trap is formed between the bottom portion of the another piston and the bottom portion of the cylinder according to the upward movement of the another piston, and the air trap is released according to the downward movement of the another piston.

12. The hinge for automatically-closing a door which opens in both directions according to claim 11, wherein the fluid pressure shock absorbing mechanism is a hydraulic shock absorbing mechanism configured to use a hydraulic pressure to absorb a shock caused by the movement of the piston to the other end side.

13. The hinge for automatically-closing a door which opens in both directions according to claim 11, wherein the fluid pressure shock absorbing mechanism is a pneumatic shock absorbing mechanism configured to use pneumatics to absorb a shock caused by the movement of the piston to the other end side.

14. A structure for a door which opens in both directions which allows opening and closing inward and outward, wherein the hinge for automatically-closing a door which opens in both directions according to claim 11 is installed on a door supporting portion or a door, and a receiving hinge to be attached to the hinge for automatically-closing a door which opens in both directions is installed on the door or the door supporting portion.

15. The hinge for automatically-closing a door which opens in both directions according to claim 10, wherein the fluid pressure shock absorbing mechanism is a hydraulic shock absorbing mechanism configured to use a hydraulic pressure to absorb a shock caused by the movement of the piston to the other end side.

16. The hinge for automatically-closing a door which opens in both directions according to claim 10, wherein the fluid pressure shock absorbing mechanism is a pneumatic shock absorbing mechanism configured to use pneumatics to absorb a shock caused by the movement of the piston to the other end side.

17. A structure for a door which opens in both directions which allows opening and closing inward and outward, wherein the hinge for automatically-closing a door which opens in both directions according to claim 10 is installed on a door supporting portion or a door, and a receiving hinge to be attached to the hinge for automatically-closing a door which opens in both directions is installed on the door or the door supporting portion.

18. The hinge for automatically-closing a door which opens in both directions according to claim 1, wherein the fluid pressure shock absorbing mechanism is a hydraulic shock absorbing mechanism configured to use a hydraulic pressure to absorb a shock caused by the movement of the piston to the other end side.

19. The hinge for automatically-closing a door which opens in both directions according to claim 1, wherein the fluid pressure shock absorbing mechanism is a pneumatic shock absorbing mechanism configured to use pneumatics to absorb a shock caused by the movement of the piston to the other end side.

20. A structure for a door which opens in both directions which allows opening and closing inward and outward, wherein the hinge for automatically-closing a door which opens in both directions according to claim 1 is installed on a door supporting portion or a door, and a receiving hinge to be attached to the hinge for automatically-closing a door which opens in both directions is installed on the door or the door supporting portion.

* * * * *